US005143108A

United States Patent [19]

Kenney

[11] Patent Number: 5,143,108

[45] Date of Patent: Sep. 1, 1992

[54] BEACH UMBRELLA

[76] Inventor: Robert J. Kenney, 20 E. Linden St., Alexandria, Va. 22301

[21] Appl. No.: 470,697

[22] Filed: Jan. 26, 1990

[51] Int. Cl.[5] ..... A45B 3/00

[52] U.S. Cl. ..... 135/16; 108/151; 248/156; 248/530

[58] Field of Search ..... 135/20 R, 16; 108/151; 312/252; 248/156, 530, 545

[56] References Cited

U.S. PATENT DOCUMENTS

| | | | |
|---|---|---|---|
| 1,282,241 | 10/1918 | Kosmerl | 312/252 |
| 1,472,570 | 10/1923 | Snider | 312/252 |
| 1,929,677 | 10/1933 | Davis | 312/252 X |
| 3,227,867 | 1/1966 | Baker . | |
| 3,245,421 | 4/1966 | Braun et al. . | |
| 3,434,484 | 3/1969 | Dilullo | 135/16 |
| 3,910,631 | 10/1975 | Ibara | 248/156 X |
| 4,154,255 | 5/1979 | Weaver . | |
| 4,649,678 | 3/1987 | Lamson | 248/530 X |
| 4,706,921 | 11/1987 | Paulin | 248/530 X |
| 4,832,163 | 5/1989 | Levesque | 135/20 R X |
| 4,867,187 | 10/1989 | Devine . | |
| 4,910,902 | 3/1990 | Anderson | 248/545 X |
| 4,915,670 | 4/1990 | Nesbit | 135/16 X |
| 4,924,893 | 5/1990 | Furey . | |
| 4,938,549 | 7/1990 | Potter | 312/252 X |

FOREIGN PATENT DOCUMENTS

| | | | |
|---|---|---|---|
| 36199 | 4/1930 | France | 312/252 |
| 478279 | 1/1938 | United Kingdom | 312/152 |

*Primary Examiner*—David A. Scherbel
*Assistant Examiner*—Lan Mai
*Attorney, Agent, or Firm*—Birch, Stewart, Kolasch & Birch

[57] ABSTRACT

A portable beach umbrella is provided having a plurality of rotatable accessible utility levels for storing necessary beach equipment. The umbrella also includes a refreshment support member, entertainment devices, and is easily secured to sand or ground for stability while in use.

11 Claims, 3 Drawing Sheets

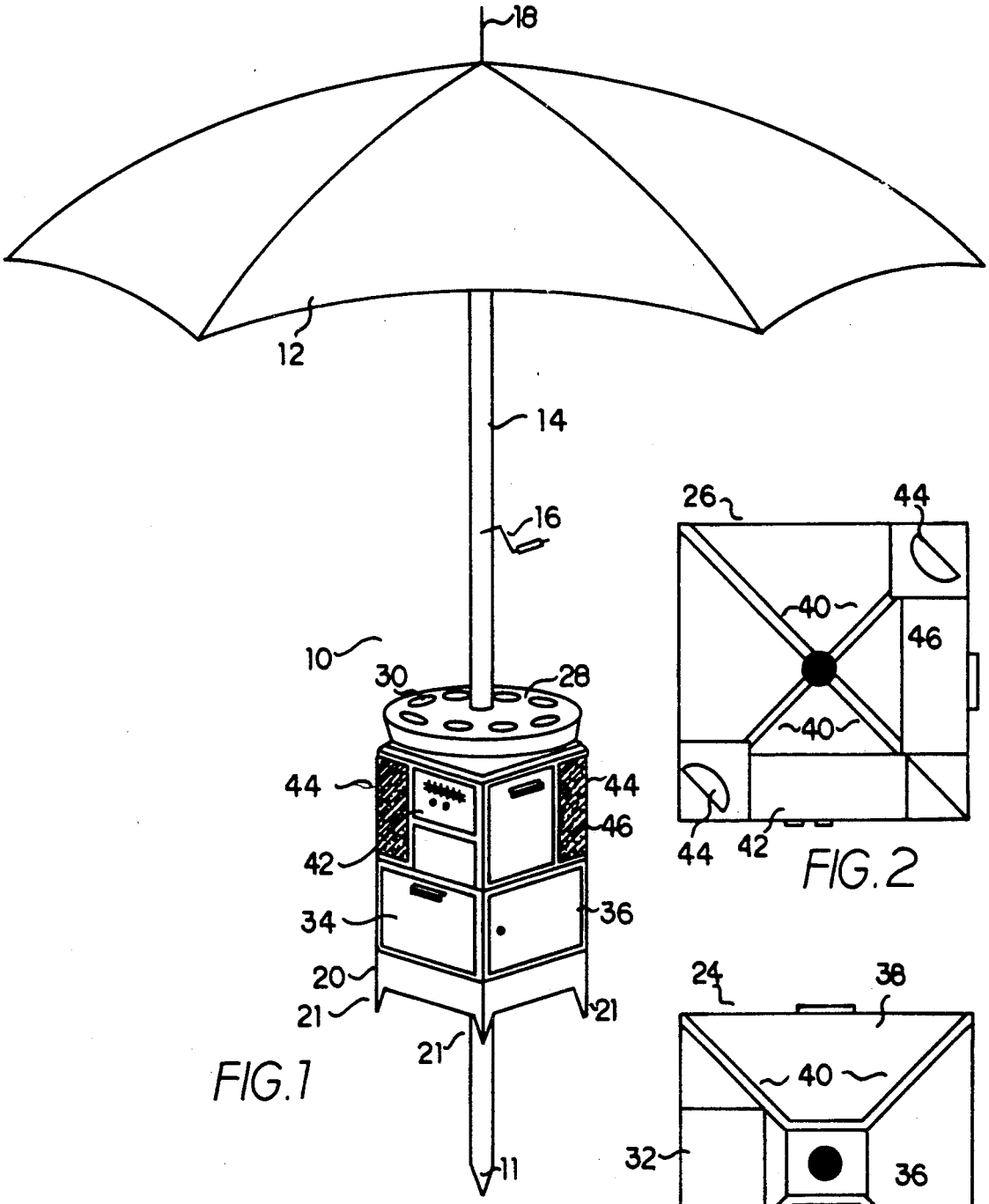
FIG. 1
FIG. 2
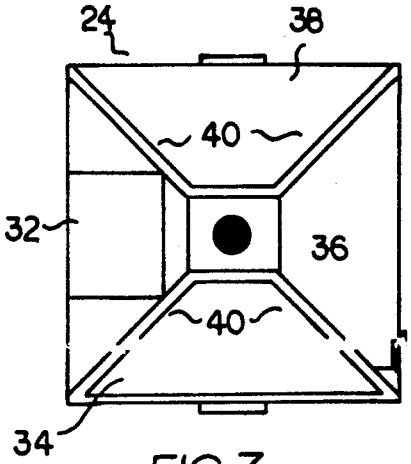
FIG. 3

BEACH UMBRELLA

BACKGROUND OF THE INVENTION

1. Field of the Invention

The present invention is directed to a portable beach umbrella, and more particularly, to a portable beach umbrella having distinct accessible utility levels rotatable about a central axis defined by the beach umbrella pole and containing necessary beach equipment in a single, portable compact arrangement.

2. Description of Related Art

Heretofore in the art of portable beach umbrellas, there has only been included the umbrella member and a central support shaft or pole. Any compartments or storage areas are generally in the form of pockets lining the canvas umbrella per se. This arrangement places stored items far out of reach of the beach umbrella enthusiast, thereby making it difficult to obtain suntan lotion or other storable items.

Even further, as any beach-goer or sunworshipper is aware, the long hours spent on the beach require toting of coolers, tape-decks, radios, bags for trash, and at least a beach bag for storing wallets, car keys and the like. Another common problem is preventing sand from getting into a beverage can or bottle when the can or bottle is secured in the sandy ground. Finally, it is always a concern that valuables, including money, may not be safe if left for any extended period of time while the beach-goer is swimming, walking, or at the refreshment stand.

Accordingly, a need in the art exists for a portable beach umbrella which offers easily accessible storage areas, drink holders, entertainment and the like. Such a need has not heretofore been recognized or satisfied in a manner contemplated by the present invention.

SUMMARY OF THE INVENTION

Accordingly, it is a primary object of the present invention to provide an efficient lightweight, compact and portable beach umbrella which includes essential conveniences for the serious beach-goer or for the person who appreciates being pampered when they are at the beach.

The primary object of the present invention is fulfilled by providing a portable beach umbrella comprising: a vertical central support shaft; a closable umbrella member mounted adjacent an upper end of said support shaft; a base member mounted adjacent a lower end of said support shaft for stabilizing said beach umbrella; an interiorly accessible compartment member mounted on said base member at an axially central portion of said compartment member; and means for supporting refreshments on top of said compartment member.

The accessible compartment member of the beach umbrella is rotatable at the central axis thereof about the vertical central support shaft and the base member includes a plurality of depending leg members insertable into soft ground upon insertion of the central pole member into the ground. In addition, the refreshments are supported in a rotatable drink tray having a plurality of beverage receptacles formed therein. The drink tray may also be rotatable about the central support shaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, thus, are not limitative of the present invention, and wherein:

FIG. 1 is a front perspective view of a beach umbrella according to the present invention;

FIG. 2 is a top plan view of an upper compartment level of the beach umbrella shown in FIG. 1;

FIG. 3 is a top plan view of a lower compartment level of the beach umbrella shown in FIG. 1;

DESCRIPTION OF PREFERRED EMBODIMENTS

Figures 4, 5:
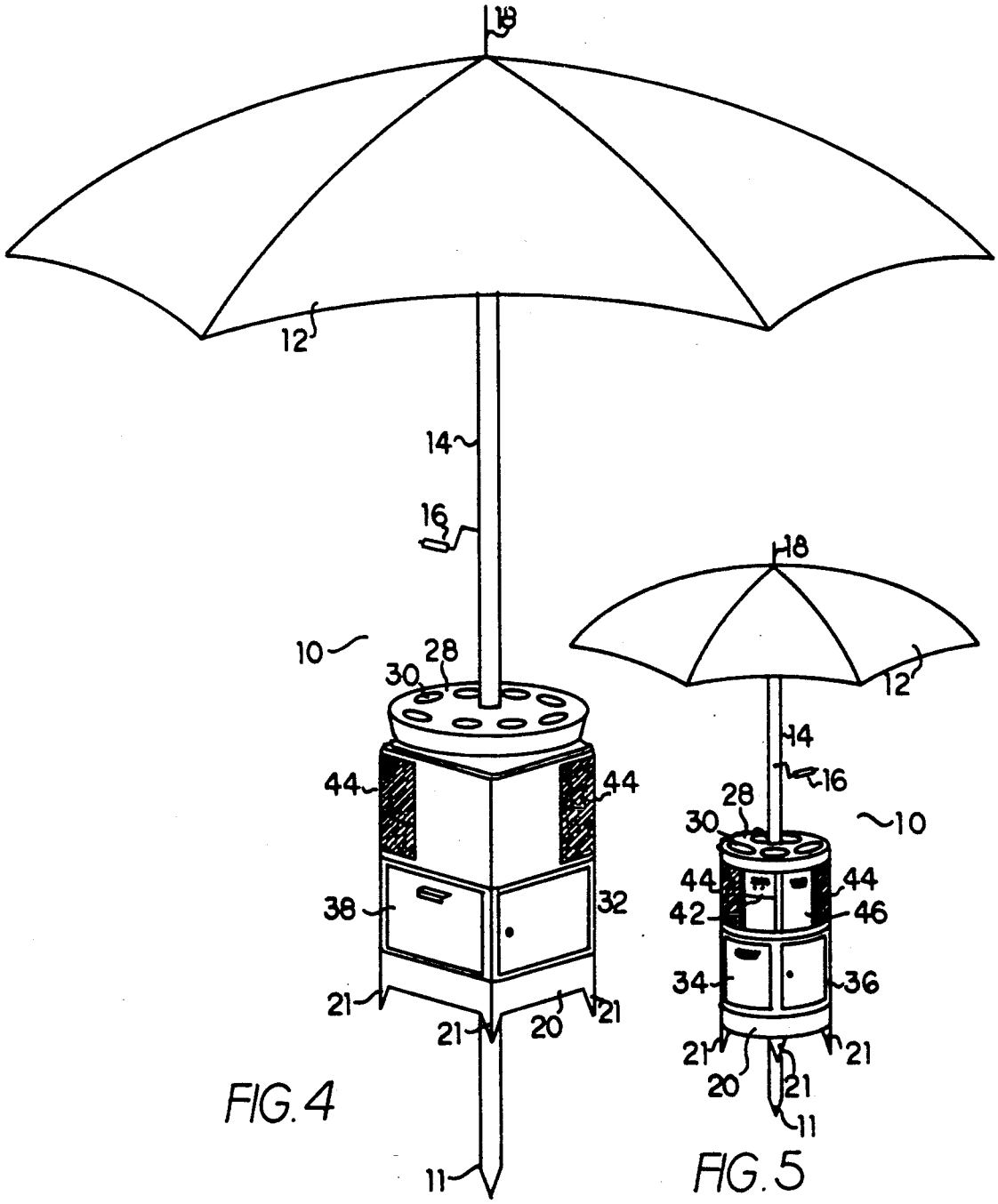
FIG. 4 is a rear perspective view of the beach umbrella shown in FIG. 1.
FIG. 5 is a front perspective view of a beach umbrella according to a second preferred embodiment of the present invention.

Referring to FIG. 1, there is generally shown a portable beach umbrella 10. The beach umbrella 10 includes an umbrella or shade member 12 which may be canvas, plastic or any other suitable flexible shading material and is openable and closable by a handle member 16 rotatably fixed to a central support shaft 14.

Central support shaft 14 should be made of a lightweight, yet sturdy material such as aluminum, PVC, or other suitable plastic. The shaft 14 has an upper end at which the shade member 12 is mounted and a base end 11 of a suitable shape to pierce soft ground or sand. Further, the shaft 14 should be substantially uniform in cross section in order to enable smooth rotation therearound by additional umbrella parts to be described below.

FIG. 2 is a top plan view of a second level 26 or compartmented member which is shown permanently mounted on the central support shaft 14 in FIG. 1.

Figure 6B:
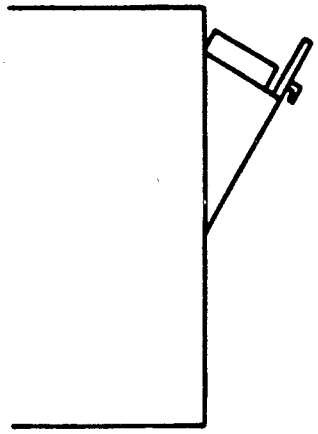
FIG. 6B is a partial unornamented side view of FIG. 6A showing the cassette storage area in an open position.
Figure 6A:
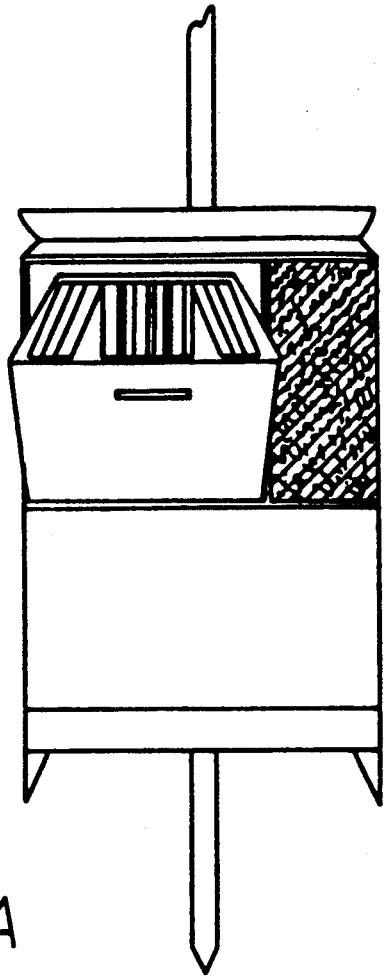
FIG. 6A is a front view of an open cassette storage area for the embodiment shown in either of FIGS. 1 or 5.

The second or upper level 26 includes a utility drawer 46, a radio/cassette player 42, and at least a pair of speakers 44 positioned on opposing sides of the second level 26 so as to achieve maximum stereo sound therefrom. The utility drawer 46 may include cassette storage area as shown in FIGS. 6A and 6B whereby the drawer 46 pulls down to view the cassette tape labels for easy selection thereof.

Similar to the other elements of the beach umbrella, the upper level 26 is made of a suitable lightweight material, preferably plastic, which is both durable and easily portable. The utility drawer 46 may pivotably open about either a side hinge or a lower hinge in order to gain access to the compartment. Any conceivable use may be made of this compartment including storage of reading materials, suntan lotion, excess trash, cassette storage or the like.

The radio/cassette player 42 is of any known portable type listening center, and will operate on battery power. In order to enhance radio reception, an antenna 18 is fixed to the top of the central support shaft 14 above the shade member 12.

For structural stability, the upper level 26 is fixed with a plurality of dividers 40 at spaced intervals within the compartment, the dividers 40 preferably extending from a central shaft opening 41 to the outer respective four corners of the upper level with the exception of the corners containing speakers 44, in which case the dividers 40 abut the speakers 44.

FIG. 3 is a top plan view of a first level 24 or compartmented member which is shown permanently mounted on the central support shaft 14 in FIG. 1.

The first or lower level 24 includes a battery 32, a trash receptacle 38, a lock box 36, and an ice drawer or cooler 34.

Similar to the other elements of the beach umbrella 10, the lower level 24 is made of a suitable lightweight material, preferably plastic, which is both durable and easily portable.

The battery 32 operates the radio/cassette player 42 and is preferably positioned in an out-of-the-way location, such as on the far side of the lower level with respect to the user. The trash receptacle 38 holds an amount of trash which would be normally generated on the beach in a single day and includes a handle **38*a* shown positioned at the top of a trash receptacle door 38*b*. Accordingly, when the handle 38*a* is pulled, trash receptacle 38 openly rotates about hinged or pivot structure (not shown) at the base of the receptacle door 38*b*. While the trash receptacle door 38*b*** may also pivot about a hinge member on either vertical side of the door, such an arrangement is less convenient as requiring additional trash bag supports or the like, whereas a "pull-down" door offers a built-in three or four-sided container.

The lock box 36 is for safe-keeping of valuables and may be locked with either a key or a padlock. While the lock-box 36 is shown to open about a vertical axis, any convenient position of the lock may be used.

As previously indicated, the ice drawer of cooler 34 is an essential beach element for storing cold refreshments, snacks and the like. Shown here, the cooler 34 will pull-down about a lower hinged pivot point, but the handle may be placed in any convenient location with a corresponding change in location of the pivot point.

For structural stability, the lower level 24 is fixed with a plurality of dividers 40 similar to those used in the upper level 26. The dividers 40 are positioned at spaced intervals within the compartment, and preferably extend from a central shaft opening 41 to the outer respective four corners of the lower level 24. The dividers 40 should be of sufficient strength and rigidity to prevent access to the lock-box 36 through the rear of any one of the compartmented areas 38 or 34.

As shown in FIG. 1, a base member 20 is provided to be permanently fixed to the central support shaft 14. The base member 20 includes a plurality of depending leg members 21 which, when the lower end 11 of the central support shaft 14 is inserted into the ground, will assist in anchoring the portable beach umbrella 10.

Sitting upon the base member 20 is the first or lower level 24. The second or upper level 26 is mounted on the central support shaft above the lower level 24. Each of these lower and upper levels 24, 26 may be either independently or simultaneously rotated about the central support shaft 14. This rotatable feature allows access to any one of the above-described compartments by a stationary user. Accordingly, a convenient and self-contained lounging area is provided to the beach-goer which requires only minimal effort to operate.

Of course, the upper level 26 and lower level 24 may be interchanged if necessary to provide more convenient access to the different compartments. Further, the particular arrangement of compartments is described as a preferred embodiment only, and any other particular arrangement may be had at the time of manufacture.

Mounted on top of the upper level 26 is the drink tray 28 having a plurality of beverage receptacles 30 formed therein. Similar to the first and second levels 24, 26, the drink tray 28 is rotatable about the central support shaft 14 for convenient access to any one of the beverage receptacles 30.

The overall height of the combined base 20, first level 24, second level 26, and drink tray 28 is within the range of 2–3 feet off the ground so that even the uppermost drink tray 28 is within easy reach of a person laying or sitting underneath the portable umbrella 10.

FIG. 4 is a rear perspective view of the portable umbrella 10 and shows the location of the battery 32 and lock-box 38 in the lower level 24. It should be noted that there are no compartments provided on the back side of the upper level 26 between speakers 44. This area may be modified, however, to include any desired type of compartmented area.

As shown in FIG. 5, the structure of the base 20, lower level 24, upper level 26 and drink tray 28 need not be rectangular, but may be circular in shape. Each of the respective compartments is modified accordingly.

Figure 7:
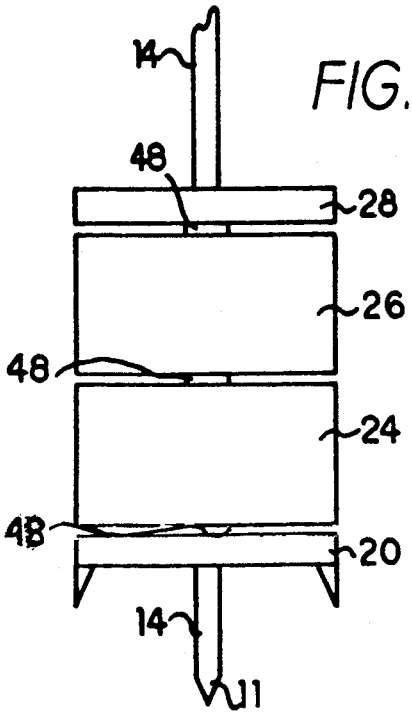
FIG. 7 is a cross-sectional unornamented view showing the relationship of the base, lower level, and upper level.

FIG. 7 is a cross-sectional view showing the mounting of each the base 20, lower level 24, and upper level 26. Preferably, the base 20 is fixed with respect to the central support shaft 14 and anchored to a soft surface via legs 21, lower level 24 is slightly spaced apart from the base 20 by a spacer member 48 either integrally formed with the base 20 or the lower level 24 or alternatively being formed as a distinct disc member placed therebetween. Similarly, a spacer member 48 is either integrally formed with lower level 24 or upper level 26 to form a space therebetween or is alternatively a distinct spacer member positioned therebetween. The spacer member 48 enables the free rotation of each of lower level 24 and upper level 26 with respect to each other and therefore provides easy access to any portion of either level 24, 26 while the user remains comfortably seated. With each of levels 24 and 26 being independently rotatable with respect to each other, it will be understood that respective wiring, batteries and the like will be included in the appropriate level so as to preclude the possibility of twisted wiring between the two levels. If, however, the ultimate arrangement of compartments, batteries, radio/cassette and the like necessitates wiring between the two levels, then the two levels may be rigidly connected to rotate simultaneously. In any event, the rotatable drink tray 28 is freely rotatable with respect to the upper level 26 at all times. To assist in rotation of the respective levels, ball bearings or other suitable friction-reducing items may be utilized as are known by one of ordinary skill in the art.

Although the preferred embodiment of the present invention is described in the context of a beach environment, it should be understood that the device disclosed and claimed may be used in a recreational manner in any suitable location and that its utility is not confined to the beach.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A portable beach umbrella comprising:

a vertical central support shaft;

a closable umbrella member mounted adjacent an upper end of said support shaft;

a base member mounted adjacent a lower end of said support shaft for stabilizing said beach umbrella, wherein said base member includes a plurality of depending leg members insertable into soft ground subsequent to insertion of a base end of said central support shaft into the soft ground;

an interiorly accessible compartment member mounted on said base member and around said support shaft, said shafts located at an axially central portion of said compartment member, said interiorly accessible compartment member including a first utility level mounted on said base member and a second utility level mounted on said first utility level, each of said first and second utility levels being independently rotatably at central axes thereof about said vertical central support shaft; and means for supporting refreshments on top of said compartment member.

2. The beach umbrella according to claim 1, wherein said means for supporting refreshments is a drink tray including a plurality of beverage receptacles, said drink tray being rotatably at a central axis thereof about said vertical central support shaft.

3. The beach umbrella according to claim 1, wherein said first utility level includes a battery box, a trash receptacle, a lock box, and an ice drawer, each spaced apart and mounted in an interior compartment space of said first utility level.

4. The beach umbrella according to claim 1, wherein said second utility level includes a utility drawer, a radio, and a pair of speakers mounted on opposing sides of the radio, said drawer, radio and speakers being mounted in an interior compartment space of said second utility level.

5. The beach umbrella according to claim 1, wherein said means for supporting refreshments are independently rotatable at central axes thereof about said vertical central support shaft.

6. The beach umbrella according to claim 1, wherein said base member, compartment member, and means for supporting refreshments are all made of lightweight, durable plastic.

7. The beach umbrella according to claim 1, wherein said vertical shaft comprises lightweight aluminum.

8. A portable beach umbrella comprising:

a vertical central support shaft;

a closable umbrella member mounted adjacent an upper end of said support shaft;

a base member mounted adjacent a lower end of said support shaft for stabilizing said beach umbrella;

an interiorly accessible compartment member mounted on said base member and around said support member, said support member is located at an axially central portion of said compartment member, wherein said accessible compartment member includes a first utility level mounted on said base member and a second utility level mounted on said first utility level, each of said first and second utility levels being independently rotatable about said vertical central support shaft and wherein said first utility level includes a battery box, a trash receptacle, a lock box, and an ice drawer, each spaced apart and mounted in an interior compartment space of said first utility level; and means for supporting refreshments on top of said compartment member.

9. The beach umbrella according to claim 8, wherein said base member includes a plurality of depending leg members insertable into soft ground subsequent to insertion of a base end of said central support shaft into the soft ground.

10. The beach umbrella according to claim 8, wherein said means for supporting refreshments is a drink tray including a plurality of beverage receptacles, said drink tray being rotatable at a central axis thereof about said vertical central support shaft.

11. The beach umbrella according to claim 8, wherein said second utility level includes a utility drawer, a radio, and a pair of speakers mounted on opposing sides of the radio, said drawer, radio and speakers being mounted in an interior compartment space of said second utility level.

* * * * *